US006038903A

United States Patent [19]

Traub

[11] Patent Number: 6,038,903

[45] Date of Patent: Mar. 21, 2000

[54] DUAL HEADED BENDING MACHINE

[75] Inventor: Zeno P. Traub, Vista, Calif.

[73] Assignee: Eaton Leonard, Inc., Carlsbad, Calif.

[21] Appl. No.: 09/037,724

[22] Filed: Mar. 9, 1998

[51] Int. Cl.[7] ..... B21D 7/04; B21D 9/04

[52] U.S. Cl. ..... 72/149; 72/369

[58] Field of Search ..... 72/149, 155, 157, 72/158, 159, 369, 370.01

[56] References Cited

U.S. PATENT DOCUMENTS

| | | | |
|---|---|---|---|
| 4,063,441 | 12/1977 | Eaton . | |
| 4,313,324 | 2/1982 | Pearson . | |
| 4,485,658 | 12/1984 | Stewart et al. . | |
| 4,495,788 | 1/1985 | Traub . | |
| 4,804,077 | 2/1989 | John, Jr. . | |
| 4,843,859 | 7/1989 | Togoshi . | |
| 4,888,971 | 12/1989 | Schwarze . | |
| 5,343,725 | 9/1994 | Sabine | 72/149 |
| 5,426,965 | 6/1995 | Hopf . | |
| 5,499,522 | 3/1996 | Schwarze . | |

*Primary Examiner*—Joseph J. Hail, III
*Assistant Examiner*—Rodney Butler
*Attorney, Agent, or Firm*—Brown, Martin, Haller & McClain, LLP

[57] ABSTRACT

A bending machine has a machine bed on which a pipe supporting carriage is mounted to move a pipe in a first direction toward a dual bend head assembly at the forward end of the machine bed. The assembly has a support frame and first and second spaced bend heads each rotatably mounted on the frame for rotation about a horizontal bend axis aligned with the bend axis of the other bend head. Each bend head has at least one pair of opposing bend and clamp dies defining a die cavity. The dual bend head assembly is movably mounted on the forward end of the machine bed for movement in a horizontal direction transverse to the pipe axis between at least two horizontally spaced positions in which the pipe is aligned with the die cavity of the first and second bend head, respectively.

13 Claims, 6 Drawing Sheets

DUAL HEADED BENDING MACHINE

BACKGROUND OF THE INVENTION

The present invention relates generally to pipe bending machines, and is particularly concerned with a dual headed bending machine for forming a plurality of successive bends about different bend dies.

Conventional pipe bending machines typically have a fixed, elongate machine bed supporting a moving carriage assembly carrying a rotating chuck in which a pipe section to be bent is gripped. A rotatable bending head and clamp die are located at a forward end of the machine bed, and the carriage advances the pipe between the bending die and clamp die, a section of pipe is gripped between the dies, and the bending head is rotated about a vertical axis to draw the pipe around the die and form the bend. The dies are then retracted, and the pipe is advanced longitudinally to the next location where a bend is to be formed.

If closely adjacent bends are to be formed, the bend and clamp dies must be formed with cavities having a compound curvature specific to a given pair of adjacent bends. Different bend dies are also required where bends of different radius are to be formed. Thus, the bending operation must often be stopped for manual changing of one set of bend and clamp dies for another. These tooling changes are difficult and time consuming.

Other problems arise when multiple bends are formed in a pipe. For example, where several bends are to be formed, care must be taken to ensure that a previously bent pipe portion, which will extend forwardly from the bend die, will not interfere with the bend head or other parts of the machine when the next bend is formed. In the past, it has been the practice to change dies or select other bend dies when changing from a right-hand bend to a left-hand bend, which also considerably lengthens the bending process.

Dual headed pipe bending machines have been proposed in the past to reduce these problems. U.S. Pat. No. 4,313,324 of Pearson, assigned to Eaton-Leonard Corp., describes a bending machine having a bending head carrying first and second bend die assemblies positioned at opposite ends of a common, horizontal bend die shaft. The pipe holding carriage and track are pivotable through 180° between bend axes defined on diametrically opposite, left and right positions of the machine bed so as to align the pipe with the respective bend die assemblies. Movement of the pipe back and forth between the two positions can be time-consuming.

In U.S. Pat. No. 4,843,859 of Togoshi, a dual headed pipe bender is described in which opposite left and right hand bending dies are mounted for rotation about spaced, vertically extending axes, and are supported on a support frame mounted on a carriage which is movable back and forth across the front end of the machine bed to move the bending dies in a direction transverse to the pipe axis, bringing a selected bending die into alignment with the pipe to be bent. The clamp die assemblies rotate in opposite directions to form right and left hand bends. This requires movement of the bend heads along a relatively long travel path between the two alignment positions, since a relatively large separation is required between the vertically oriented bend heads. Also, interference problems can arise when successive bends are formed by bending pipe along a vertical bend axis.

U.S. Pat. No. 5,499,522 of Schwarze describes a double-head pipe bending machine which has right and left hand bending heads positioned on opposite sides of the central axis of a machine bed, and the pipe holding carriage is supported on a slide which moves the carriage horizontally between the right and left hand bending heads. Each bend head is mounted for rotation about a vertical axis, with the right hand bend head performing right handed bending, and the left hand bend head performing left handed bending.

The Schwarze machine involves horizontal translation of a tube which is held at the carriage only, which may produce a cantilever effect and resultant alignment problems, particularly where a relatively long tube is to be bent. This arrangement also may cause interference problems where previously formed bends interfere with the bend head or other parts of the machine when subsequent bends are formed. Also, the pipe must be moved a relatively long distance to align with the respective bend heads, due to the separation required between two vertically oriented bend heads to avoid interference.

SUMMARY OF THE INVENTION

It is an object of the present invention to provide a new and improved dual headed bending machine.

According to one aspect of the present invention, a dual headed bending machine is provided, which comprises a machine bed having a forward end, a carriage mounted on the machine bed for motion in a first direction towards the forward end of the machine bed, a pipe holder on the carriage for supporting a pipe having an axis aligned with the first direction, a bending assembly having first and second pairs of opposing die sets, each die set pair defining at least one die cavity and rotatably mounted for rotation about a horizontal bend axis coaxial with the bend axis of the other die set pair, and the die pairs being spaced from one another along the bend axis, and a mounting assembly movably mounting the bending assembly at the forward end of the machine bed for movement in a direction transverse to the pipe axis and parallel with the bend axis between at least two horizontally spaced positions in which the pipe is aligned with a die cavity in the first and second pair of dies, respectively.

Since the bend die sets are positioned along a horizontal axis, only a relatively small movement of the bending assembly is required to move the pipe from one bend head to another. Preferably, two spaced sets of dies are provided with each die set forming a plurality of die cavities positioned side by side along the horizontal bend axis, with the die cavities defining different bend forms. Each die pair in a set includes a bend die and an opposing clamp die. This arrangement allows a large number of different bend combinations to be performed with the same bend die sets, without needing to change the bend die sets manually during a single pipe bending operation. This increases the speed of the process considerably. The bending assembly is movable in a horizontal direction between a plurality of spaced horizontal positions to align each of the die cavities with the pipe axis.

Since the die pairs are configured to bend the pipe upwardly around a horizontal axis, rather than around a vertical axis, the bending envelope is increased since the floor is eliminated as a potential zone of interference, decreasing the risk of interference of the pipe with the floor or machine support surface. This configuration also allows the spaced die sets to be positioned closer together than was possible in previous dual headed benders, reducing the amount of movement needed and increasing rigidity.

The bending assembly is preferably also movable in a vertical direction to move the upper, bend dies between a raised, retracted position spaced above a pipe in a bending position, and a lowered position engaging the upper portion of the pipe, and also to accommodate dies of varying center line radius. The clamp dies are preferably movably mounted on a bend arm which rotates to perform the bending operation, and are movable between a retracted, lowered position and a raised position to form a die cavity gripping the pipe with the bend dies in the lowered position. A pressure die is also provided on the assembly to bear against the pipe at a location rearward of the bend and clamp dies, and the pressure die is preferably movable in a direction coaxial with the pipe to feed the pipe longitudinally during a bending operation.

In this invention, the entire bend head assembly is mounted to translate in a direction transverse to the pipe axis so as to move either a left hand or a right hand die set into alignment with the pipe, and to position any one of a plurality of die cavities in each die set into alignment with the pipe. Thus, rather than having to move the pipe and carriage transversely, which can cause alignment problems, the more rigid bend head assembly is instead translated from side to side as required by the previous bend configuration. The dual bend heads also permit radical bends (i.e. 90° or more) to be made more readily. It is possible in such cases that the finished part or tube will strike a portion of the machine if the next bend is made in the same sense. However, by moving the other set of bend dies into position, the next bend can be made in a manner that causes the part to be bent away from interference with the machine. The dual head bending machine of this invention allows multiple, closely spaced bends to be made quickly and easily without requiring frequent stopping or die changing.

BRIEF DESCRIPTION OF THE DRAWINGS

The present invention will be better understood from the following detailed description of a preferred embodiment of the present invention, taken in conjunction with the accompanying drawings, in which like reference numerals refer to like parts, and in which.

DESCRIPTION OF THE PREFERRED EMBODIMENT

Figure 1:
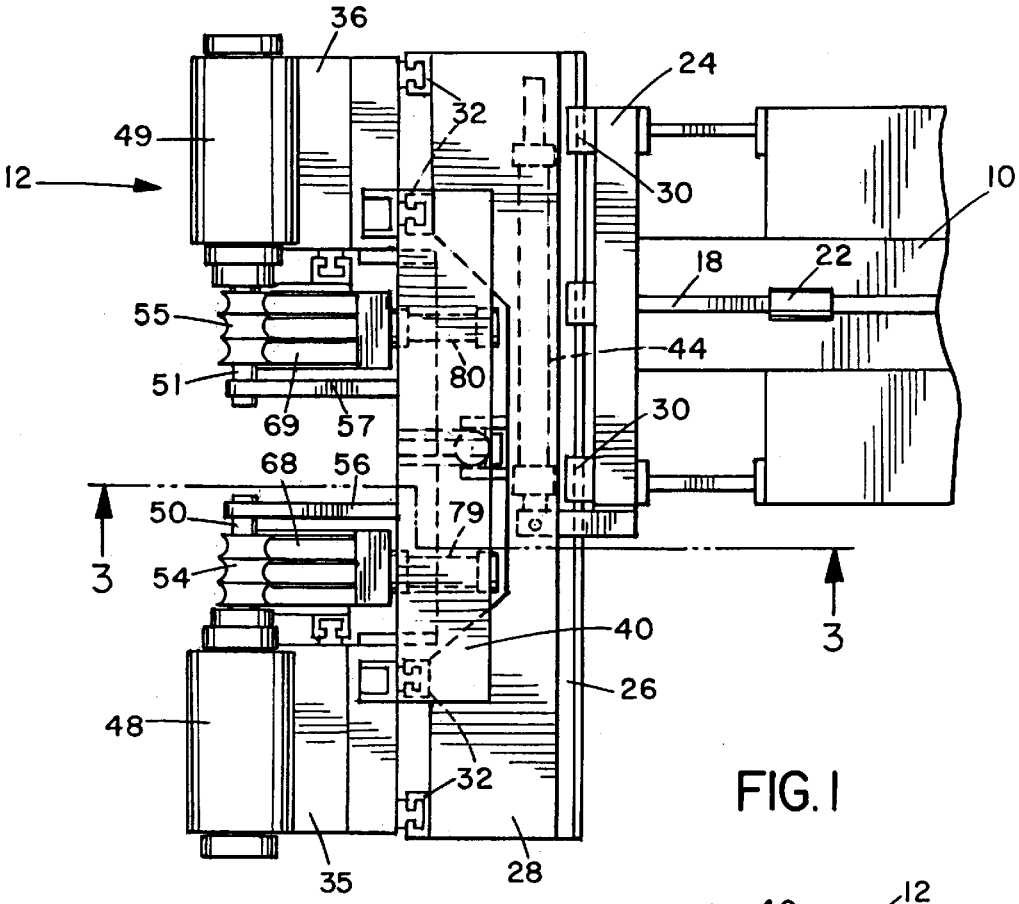
FIG. 1 is a top plan view of the dual head assembly according to a preferred embodiment of the invention.

FIGS. 1 to 5 of the drawings illustrate a dual headed, rotary draw bending machine according to a preferred embodiment of the present invention. The machine basically comprises a fixed, elongate machine bed 10 of a conventional design, at the forward end of which is mounted a dual bend head assembly 12 according to a preferred embodiment of the invention. A carriage assembly 16 is movable along longitudinal rails 18 on the machine bed and supports a pipe 20 to be bent. A rotatable chuck 22 carried on the carriage grips the pipe 20, and the mechanism is arranged to advance and rotate the pipe 20 for preselected positioning with respect to the bend head assembly. The pipe advancing and positioning mechanism is substantially identical with the types shown in prior U.S. Pat. No. 4,063,441 of Homer Eaton and U.S. Pat. No. 4,495,788 of Traub, both assigned to Eaton-Leonard Corp., the contents of which are incorporated herein by reference.

Figure 3:
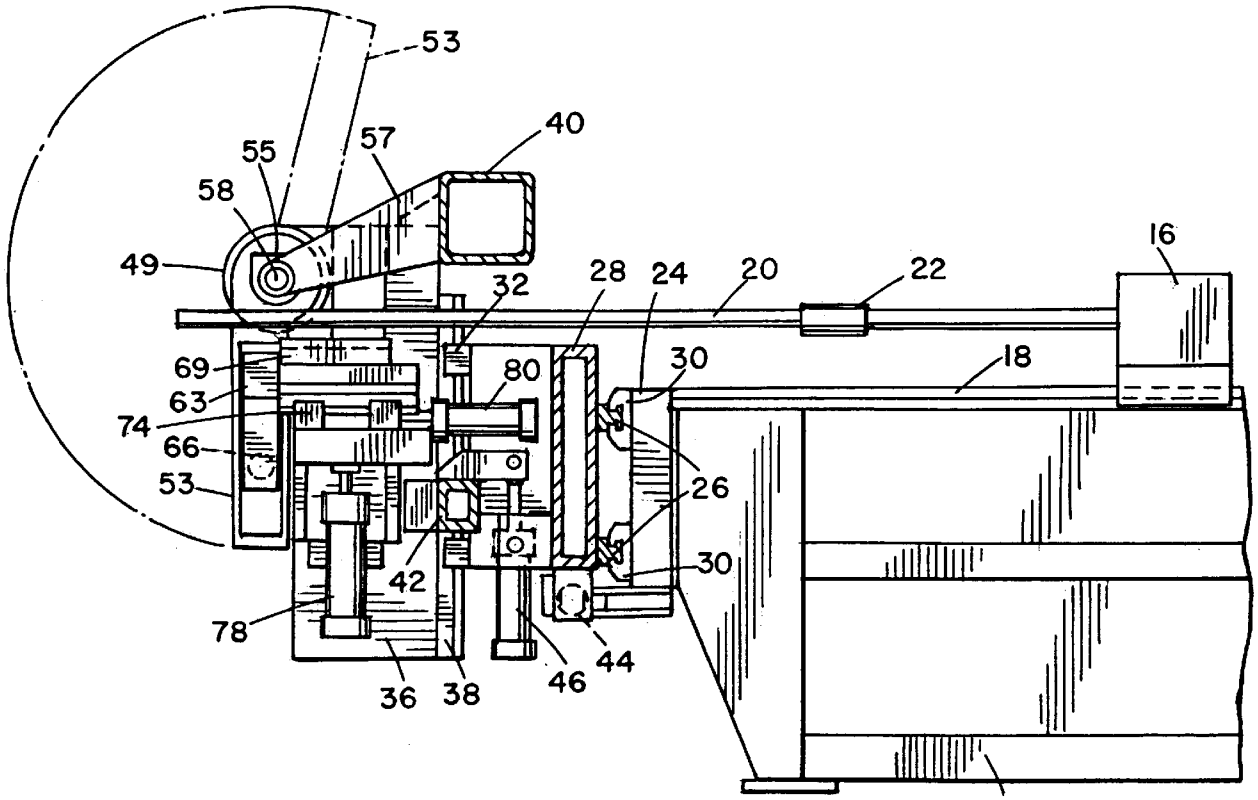
FIG. 3 is a sectional view taken on line 3—3 of FIG. 1.

In the preferred embodiment of this invention, the entire dual bend head assembly 12 is movably mounted on a fixed base plate 24 at the forward end of the machine bed, as best illustrated in FIGS. 1 and 3, so as to be movable in a direction transverse to the pipe 20 and across the front end of the machine so as to align one of two sets of dies 54, 55, selectively, with the pipe axis, as will be described in more detail below. A pair of horizontal slide rails or channels 26 are provided at the front of plate 24, and a horizontal slide block 28 is slidably mounted on rails 26 via a pair of spaced, horizontal slide bars or tongues 30 which are slidably engaged in rails or channels 26. A series of spaced, vertically extending slide channels 32 are provided at spaced intervals across the front face of slide block 28, as best illustrated in FIGS. 1 and 3. A box frame for supporting the bend die assembly has spaced, right and left hand vertical support columns 35, 36, respectively, and upper and lower cross beams 40, 42 extending between the side columns. Each side column has a pair of vertical slide bars 38 on its rear face for sliding engagement in a respective pair of slide channels 32 on the horizontal slide block 28.

Figure 5:
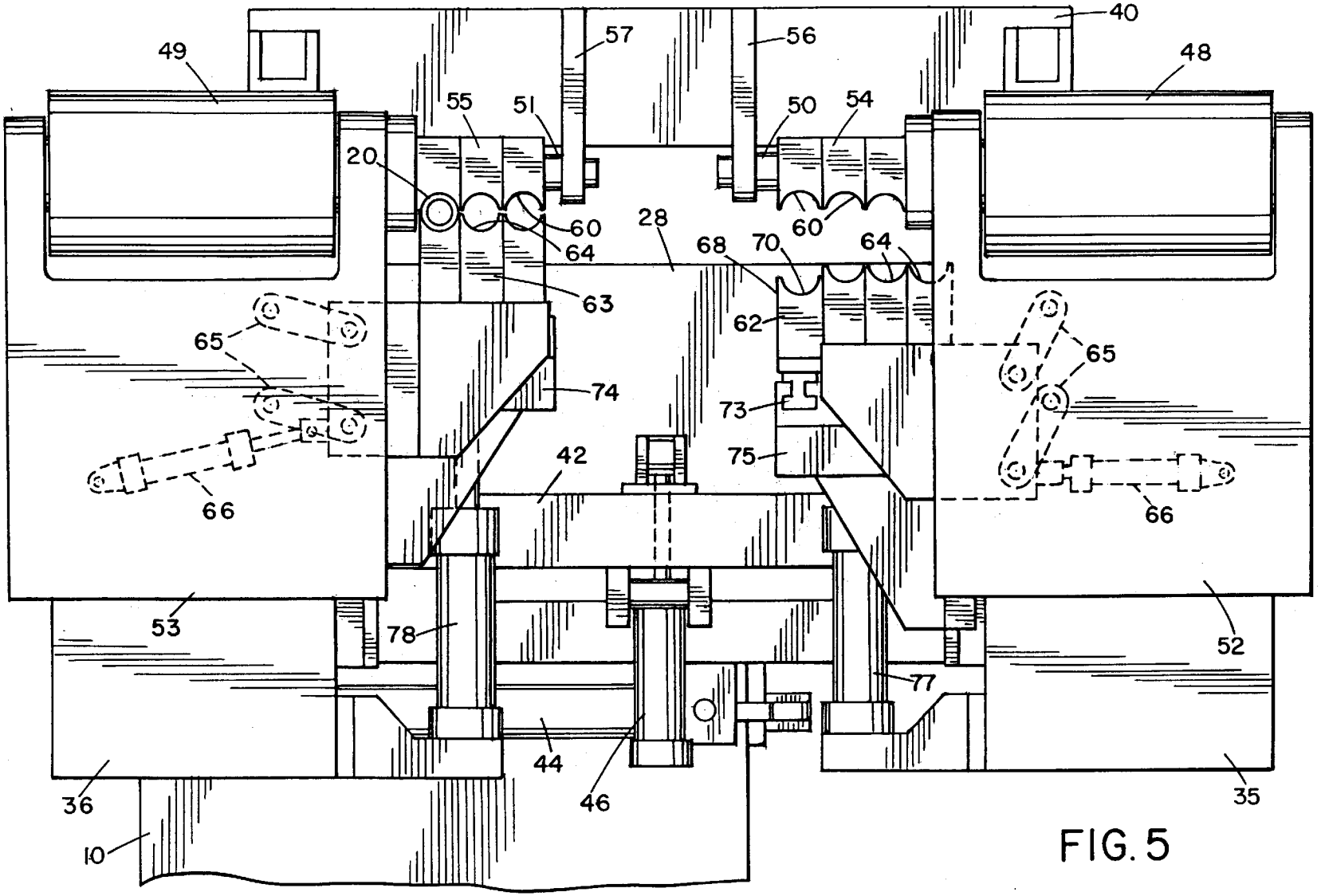
FIG. 5 is an enlarged front view showing a pipe clamped in one head unit.

A first reversible hydraulic actuator 44 is linked between the base plate 24 and the horizontal slide block 28 so as to drive the slide block back and forth on rails or channels 26, moving slide block 28 and the entire dual head bend die assembly in a horizontal direction across the front end of the machine bed. A second hydraulic actuator 46 is secured between the horizontal slide block and the box frame as best indicated in FIGS. 1, 3 and 5, in order to drive the box frame up and down along slide channels 32. Limit switches or a position controller (not illustrated) may be provided to control the end positions of the frame when moving vertically or horizontally.

A pair of spaced rotary actuators 48, 49 are secured to the upper ends of the respective columns 35, 36, to provide a reversible drive mechanism for rotating the bend dies. A rotatable drive shaft or spindle 50, 51, respectively, extends from the drive mechanism out of each actuator. The drive shafts 50, 51 are secured to a pair of swinging bend arms 52, 53, respectively, on the right and left hand sides of the machine. A stack of coaxial bend dies 54, 55, respectively, are also mounted on inwardly projecting ends of the spindles or shafts 50, 51 so as to rotate with the respective bend arms 52, 53. Each shaft or spindle 50, 51 is rotatably supported at its inner end on a support bracket 56, 57, respectively, extending from the upper cross beam, as best illustrated in FIGS. 1, 3, and 5. Thus, each bend arm and the associated bend dies rotate upwardly as a unit about a horizontal bend axis 58 between a retracted position as indicated in solid outline in FIG. 3, and an extended position as illustrated in dotted outline.

The two stacks of bend dies 54, 55 include a series of bend grooves 60 of differing curvatures. Various curvature differences may be employed, including different radii of curvature and various compound curvatures, with the curvatures on the left hand die set being different from those on the right hand die set. Preferably, each die groove or cavity has multiple bend profiles for accommodating closely spaced compound bends. By way of example, U.S. Pat. No. 4,888,971 of Schwarze describes a die with three different die profiles in a single die cavity. The selected curvatures of the bend profiles in each bend groove will be dependent on the shape of pipe to be produced by the machine. Since three bending grooves are provided in each bending die set, six different bending forms may be provided in the illustrated embodiment, or eighteen if each groove has three different bend profiles. However, a greater or lesser number of bending grooves and bend profiles in each groove may be provided in alternative embodiments, and each stack of bend dies is detachably mounted on the machine for replacement by a different stack when different pipe shapes are to be formed. U.S. Pat. No. 4,495,788, referred to above, describes a vertically oriented stack of bend dies of different bending forms, by way of example. All three of the profiles shown in this patent may be accommodated in a single die groove or cavity. It will be understood that various bending forms may be provided in the horizontally oriented die stacks of this invention, including those described in U.S. Pat. No. 4,495,788, and other forms depending on the particular application.

Due to the fact that the bend dies are positioned along multiple horizontal spindles, and each spindle is braced at its inner end at a relatively short distance from the drive mechanism, the bend dies are held more rigidly. This allows more dies to be stacked while maintaining the necessary rigidity when forming bends, unlike vertical die arrangements.

A clamp die 62, 63, respectively, is movably mounted on the respective bend arm 52, 53 for movement between a retracted position as illustrated for the right hand clamp die 62 in FIG. 5, and an extended position opposing the bend die set 54, as illustrated for the left hand clamp die 63 in FIG. 5. Each clamp die 62, 63 has a series of three clamp grooves 64 for co-operating with a respective bend groove of the opposing bend die 54, 55 to form a desired bend in a pipe, as will be understood by those skilled in the field. A greater or less number of clamp grooves may be provided, depending on the number of bend grooves. Thus, the respective clamp groove will have a radius, curvature and form matching that of the opposing bend die groove. Each clamp die 62, 63 is secured in the respective bend arm by means of a pivot linkage 65, and is moved between the retracted and extended positions by means of a hydraulic actuator 66 within the respective bend arm. The pivot linkage and actuator move each clamp die outwardly and upwardly into the fully extended position for cooperation with the opposing bend die set. The machine of this invention utilizes a clamping mechanism similar to those described in U.S. Pat. Nos. 4,870,849 and 4,760,726 of Eaton Leonard Corporation.

Figure 2:
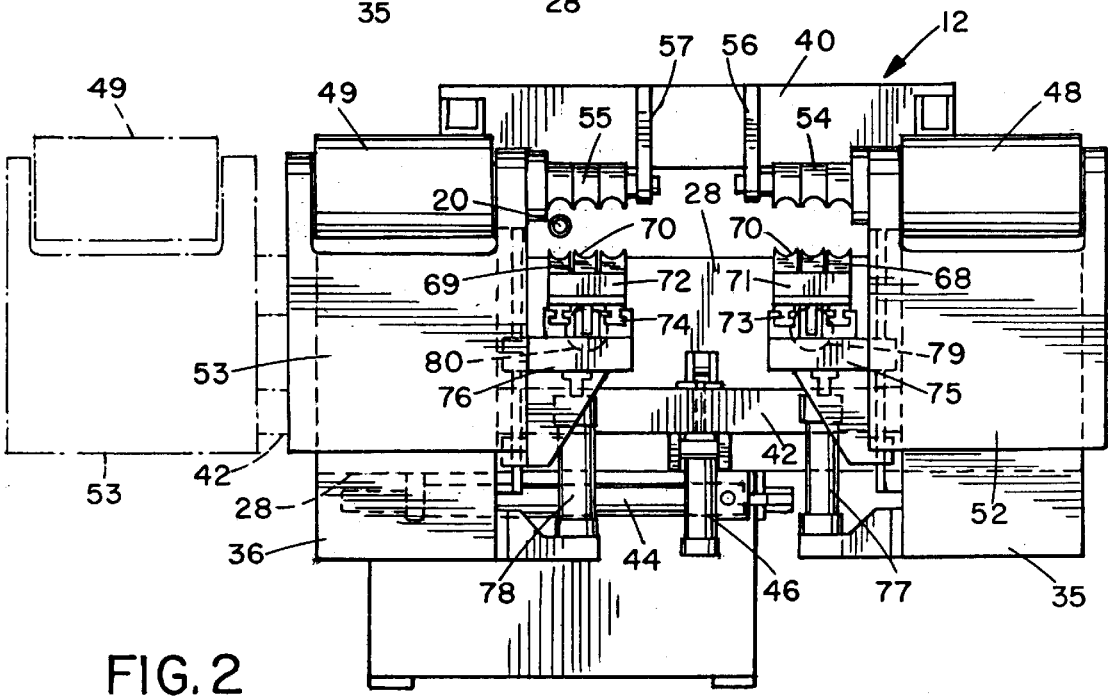
FIG. 2 is a front view of the structure, the clamping dies being omitted for clarity.

A pressure die set 68, 69 is mounted on each side of the frame behind the clamp dies for pressing the rearward portion of a pipe 20 against the respective right or left hand bend die 54, 55. Each die set 68, 69 has a series of three straight grooves 70 for pressing against the lower half of a pipe. The pressure die may have a greater or lesser number of grooves, depending on the number of bend die grooves. The pressure die sets 68, 69 are each mounted in a respective pressure die head 71, 72 which is slidably mounted on rails 73, 74 on a support member 75, 76 for movement in a direction parallel to the direction of advancement of the pipe 20. The support member 75, 76 is secured to respective hydraulic actuator 77, 78 supported at the lower end of the respective frame column 35, 36, as best illustrated in FIGS. 2 and 5. Actuators 77, 78 control vertical movement of the pressure die sets 68, 69 between the lowered, retracted position of FIG. 2 and the raised, extended position illustrated in FIG. 3, in which the currently active groove 70 will press against a pipe 20 being bent by the opposing bend and clamp dies. At the same time, horizontal actuators 79, 80 engage the respective pressure die heads 71, 72 in order to move the die heads back and forth along rails 73, 74, so that a pressure die can be urged outwardly from the front end of the machine bed in a direction co-axial with the pipe 20. This acts to feed the pipe longitudinally during the bending action, which helps in forming tight radius bends.

Figure 6A:
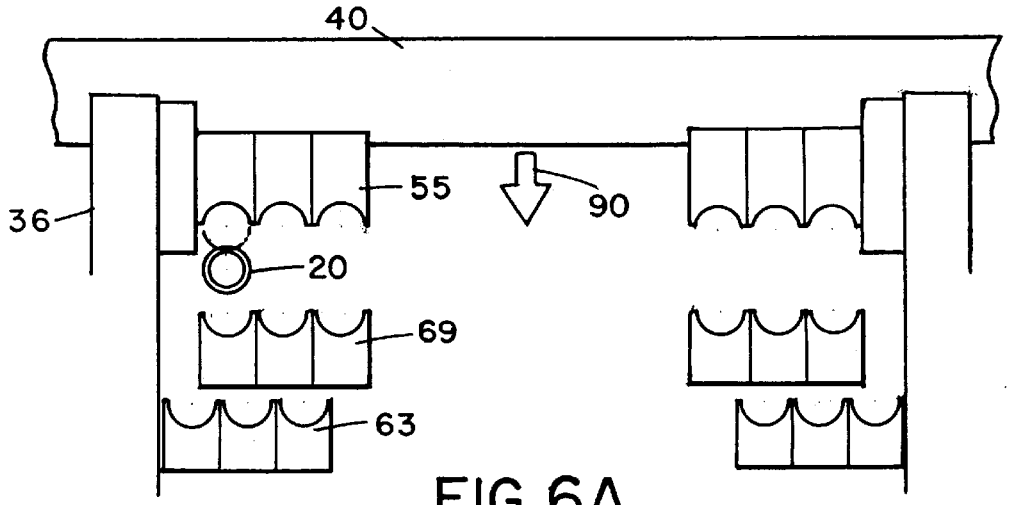
FIGS. 6A–6C illustrate diagrammatically the aligning and clamping steps.
Figure 6B:
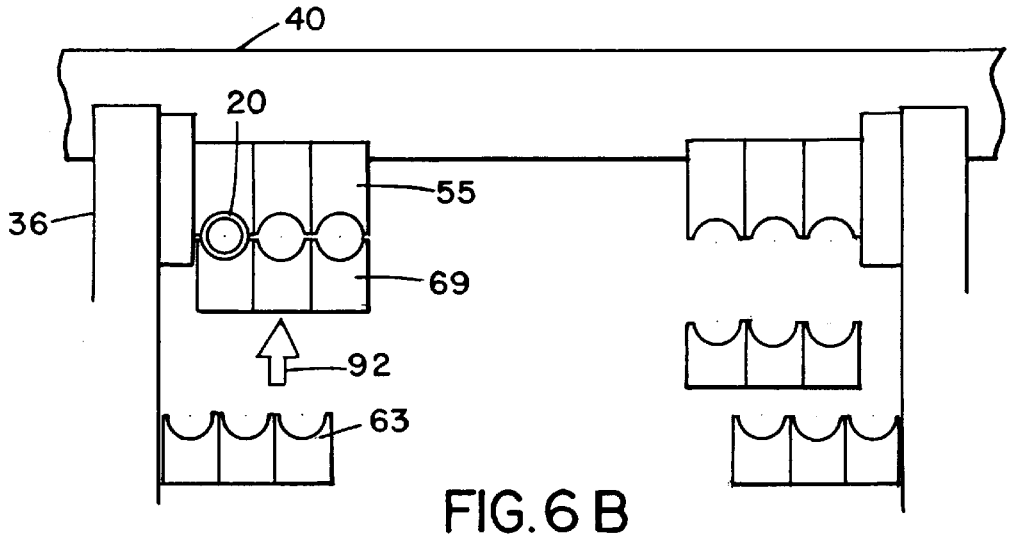
Figure 6C:
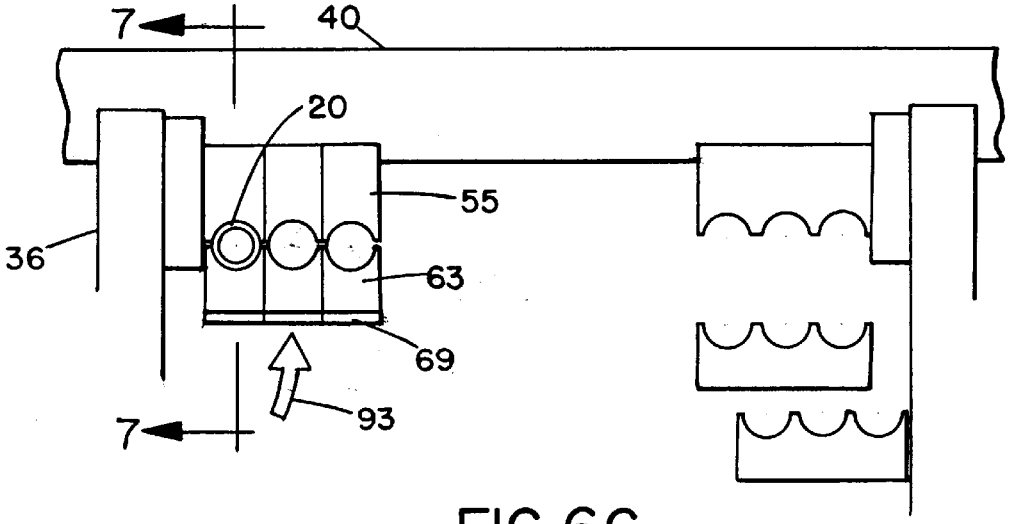
Figure 7:
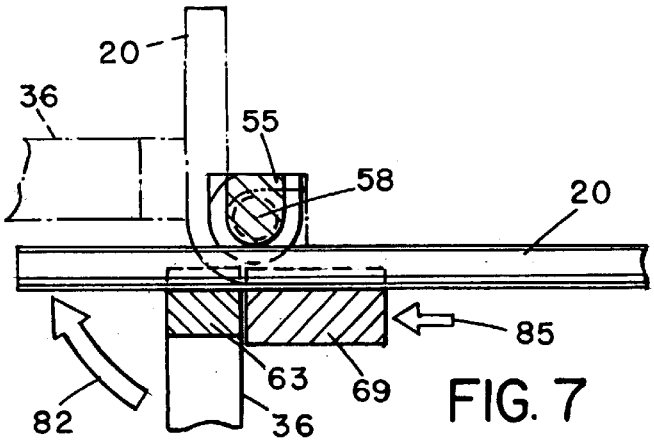
FIG. 7 is a sectional view taken on line 7—7 of FIG. 6C, showing the bending action.
Figure 8A:
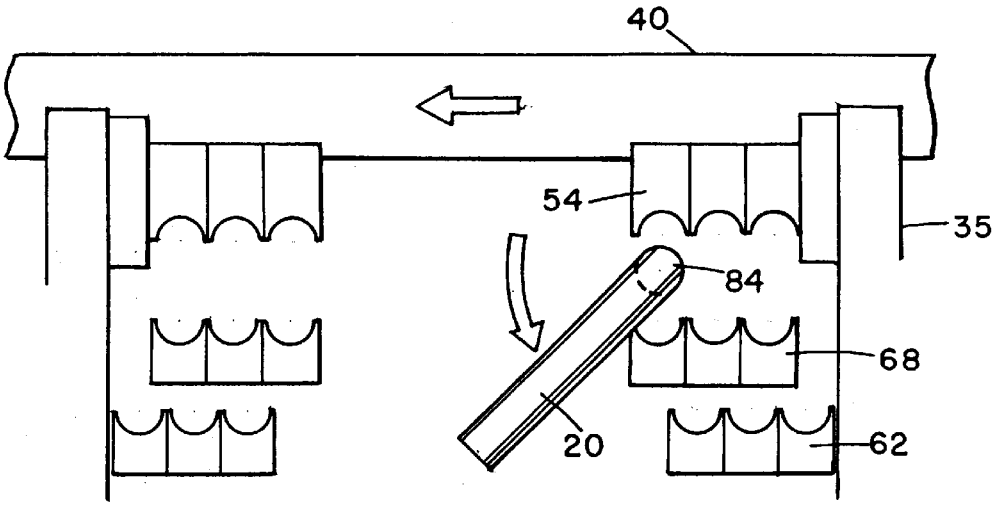
FIGS. 8A and 8B illustrate the clamping sequence repeated on the other head unit.
Figure 8B:
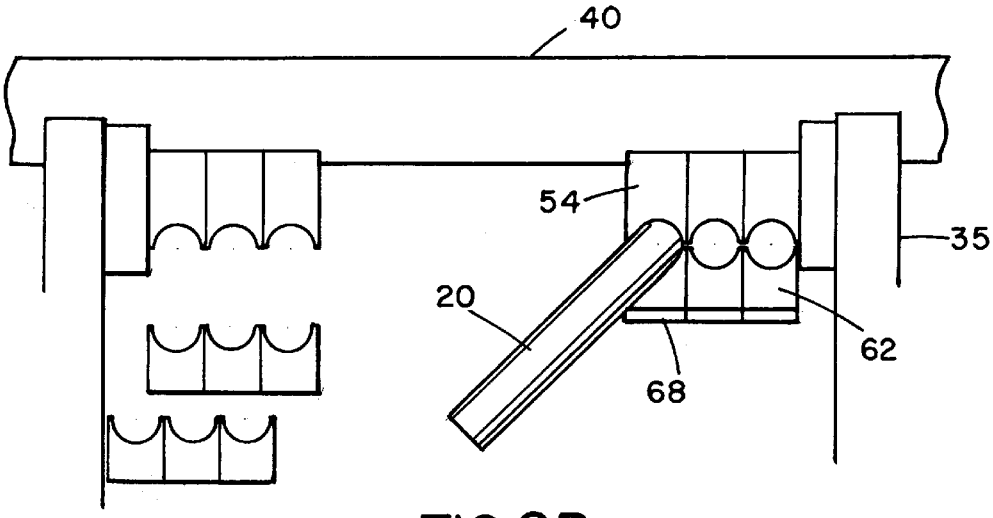
Figure 9:
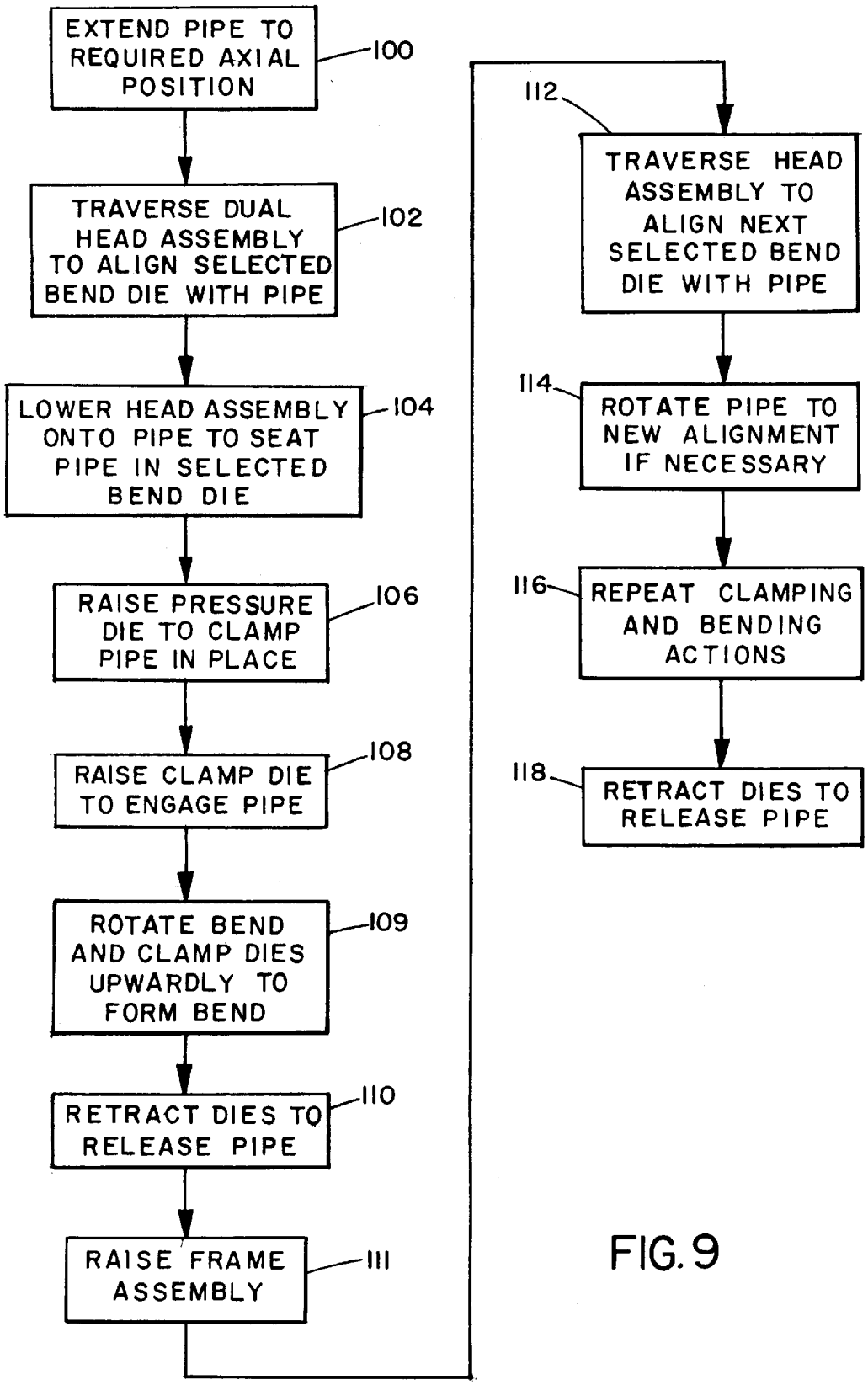
FIG. 9 is a flow chart of the operation of the machine.

The sequence of operation is schematically illustrated in FIGS. 6, 7 and 8, and in the flow diagram of FIG. 9. Initially, all dies will be in the retracted positions, and the pipe 20 will be extended by moving carriage 16 along track 18 until the required axial position is reached (step 100 of FIG. 9), in other words, the required portion of tube to be formed into the first bend is axially aligned with the bend and clamp dies. The first hydraulic actuator 44 is controlled to traverse the dual bend head assembly across the front end of the machine into a position in which a selected bend die groove of the right or left hand die set is aligned with a pipe 20 to be bent (step 102). The groove and die set selected will be dependent on the shape of the first bend to be made in the pipe. For example, say the left hand bend die set is initially aligned with the pipe. At this point, the bend die set 55 is in the raised inoperative position as illustrated in FIG. 2, and both the clamping die set 63 and the pressure die set 69 are in their lowered, inoperative positions, as also illustrated in FIG. 6A. The box frame 34 is then lowered in the direction of arrow 90 in FIG. 6A, using actuator 46 to move the frame downwardly along rails or tracks 32, until the bend die groove 60 engages the upper half of the pipe (step 104).

Figure 4:
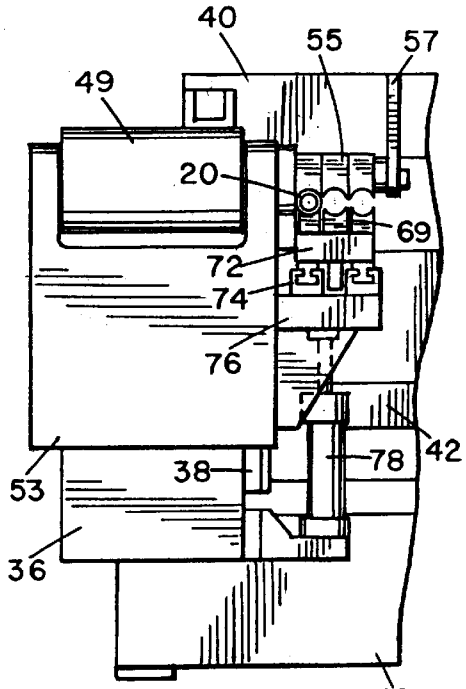
FIG. 4 is similar to a portion of FIG. 2, but showing the pressure die in the clamping position.

The pressure die set 69 is moved upwardly in the direction of arrow 92 in FIG. 6B to engage the lower half of the pipe 20 behind the bend die, as illustrated in FIGS. 4 and 6B (step 106). The clamp die set is also moved upwardly and outwardly to engage the lower half of pipe (step 108), as indicated by the arrow 93 in FIG. 6C, gripping the pipe between respective bend die groove 60 and clamp die groove 64, as indicated for the left hand pair of opposing grooves 60,64 in FIG. 4 and 6C. The grooves 60 and 64 together form a die cavity of predetermined bend shape. At this point, as indicated in FIG. 7, the left hand bend arm 36 is actuated to rotate the bend die set 55 and clamp die set 63 upwardly about the horizontal bend axis 58, as indicated by the arrow 82 in FIG. 7, thereby forming a first bend 84 in the pipe, as indicated in dotted outline (step 109). At the same time, the pressure die 69 is urged against the pipe and longitudinally in the direction of arrow 85 by actuator 80, feeding the pipe longitudinally during the bending process, to aid in forming small radius bends.

The pipe feed mechanism which moves carriage 16 is also actuated to move the pipe longitudinally to form the bend. As the bend is formed, the pipe will be pulled, and the pressure die translates to support the longitudinal pull. The amount of boost applied to the pipe by the pressure die and the pipe feed mechanism during pipe bending may be varied depending on the movement of the pipe in the die to prevent slipping of the pipe in the groove. By using a variable boost up to the maximum column strength of the pipe, a fulcrum or compression bending of the pipe is carried out, rather than a draw bending operation. In fulcrum or compression bending, a more highly relieved die that can accommodate several pipe profiles in a single die cavity can be utilized. This allows parts or tubes with closely spaced multiple bends to be made, which is not possible with conventional draw bending. Preferably, a boost drive as described in U.S.

Pat. No. 5,426,965 of Hopf, assigned to Eaton Leonard, Inc., (the contents of which are incorporated herein by reference) is used to control boost applied to the pipe during bending. In this machine, rather than pushing on the carriage, as in our prior patent, the tube itself is pushed directly, greatly reducing the amount of tube required for the last bend. By using position-controlled boost in combination with multiple die grooves, a large number of different compound bend profiles can be obtained. Each bend die groove can have three, four or more different profiles, providing eighteen or more different multiple bends.

When a first bend has been formed, all die sets are moved into the retracted position spaced from the pipe (step 110), as indicated in FIGS. 2 and 8A. The frame is then raised (step 111) to clear the tube. The head assembly is then traversed under the control of actuator 44 to align the next selected bend die with the pipe (step 112). The pipe 20 will be advanced longitudinally to the desired location of the next bend, and rotated in chuck 22 into a predetermined orientation depending on the desired orientation of the next bend to be made relative to the first bend (step 114). The selection of the right or left hand die set will depend on the form of the previous bend or bends in the pipe. If the next bend, if made in the left hand die set, could cause the pipe to contact the bend head assembly, the assembly will be moved transversely along rails 26 to align a selected groove of the right hand bend die 54 with the pipe, as indicated in FIG. 8A. The procedure is then repeated, with the bend die 54 being moved downwardly into contact with the pipe, and the pressure die 68 and clamp die 62 being moved upwardly into gripping engagement with the pipe , as illustrated in FIG. 8B. Bend arm 52 is then rotated upwardly to form the next bend (step 116), with the pressure die 68 being advanced so as to urge the pipe longitudinally as the bend is being formed. The dies are retracted (118), and the procedure is repeated until a desired sequence of bends has been formed.

The apparatus therefore has a right and left hand bend head which may be selectively aligned with the pipe in order to form a bend about a horizontal bend axis, with a plurality of different bending grooves of different bend form in each bend head. This is particularly convenient for applications where pipe is to be bent at several positions into a selected three dimensional shape, for example to form an exhaust manifold. The pipe may be bent at one or more positions by using the bending die set on one side of the machine to effect rightward bends, and by appropriately rotating the pipe by means of the pipe feed mechanism as necessary. At some point, rotation by the same bending die set may be inconvenient or impossible, due to interference with the machine because of previously formed bends, for example. At this point, the entire bending head assembly is simply translated sideways to align the bending die set on the other side of the machine with the pipe, and the bending procedure can be continued without any interference of previously bent sections with the machine.

This apparatus allows for quick and easy formation of multiple, successive multicurvature bends. The speed of bending is increased over previous bending machines for forming equivalent bent pipe sections, since it is not necessary to repeatedly stop the machine to change bend dies or move the pipe into alignment with a different bend die, for example. Instead, the entire bending head assembly can be readily moved from side to side in order to align the appropriate bending die set and die groove with the pipe. Preferably, the actuators and pipe feed mechanism are all carried out under control of a program in an automatically controlled machine, for example according to the flow diagram schematically illustrated in FIG. 9. The machine can be re-programmed as appropriate to form different pipe shapes.

This allows a series of closely adjacent bends to be formed without any problem with the pipe interfering with machine surfaces, and without needing to stop the machine to change tooling. The use of horizontally aligned bend dies which rotate along a horizontal axis also has advantages over vertical bend die arrangements, and produces an increased bending envelope by eliminating the floor as a potential zone of interference for the pipe.

This arrangement also eliminates the need to transport the pipe and carriage transversely into alignment with right and left hand bend heads, as was necessary in some prior art dual headed bending machines. Sideways movement of an elongate pipe section can give rise to alignment problems due to the cantilever effect when a long pipe section is only gripped at one point. This invention avoids alignment problems of this nature. This apparatus also has improved rigidity in the bend head mounting. Each bend head mounting shaft is relatively short and is braced at one end by a support bracket, maintaining alignment with the bend axis. Bend quality, which is a function of die rigidity, is therefore enhanced with this invention.

Although a preferred embodiment of the invention has been described above by way of example only, it will be understood by those skilled in the field that modifications may be made to the disclosed embodiment without departing form the scope of the invention, which is defined by the appended claims.

We claim:

1. A dual headed bending machine, comprising:

an elongate machine bed having a generally vertically oriented forward end, and a generally horizontally oriented upper end;

a dual bend head assembly at the forward end of the machine bed, the dual bend head assembly having a support frame and first and second spaced bend heads, each bend head being rotatably mounted on the frame for rotation about a horizontal bend axis aligned and co-axial with the bend axis of the other bend head, the bend axes extending transverse to the vertical forward end of the machine bed, each bend head having at least one pair of opposing bend and clamp dies defining a horizontally oriented die cavity, the die cavities being spaced along said horizontal bend axis;

a carriage mounted on the upper end of the machine bed for movement in a first horizontal feed direction towards the dual bend head assembly and transverse to the horizontal bend axes of the dual bend head assembly;

a pipe holder on the carriage for supporting a pipe having a pipe axis aligned with the first horizontal feed direction for relative rotation with the bend head assembly, whereby movement of the carriage in the feed direction advances the pipe into the bend head assembly; and a mounting assembly mounting the dual bend head assembly on the forward end of the machine bed for translational movement in a second horizontal direction transverse to the pipe axis and first horizontal feed direction and parallel to the horizontal bend axes between at least two horizontally spaced positions in which the pipe is aligned with the die cavity of the first and second bend head, respectively.

2. The machine as claimed in claim 1, wherein each bend head has a plurality of opposing bend and clamp dies defining horizontally spaced die cavities of different bend configurations, and the dual bend head assembly is movable horizontal back and forth across the forward end of the machine between a plurality of different horizontally spaced positions in each of which the pipe is aligned with a respective one of the die cavities.

3. The machine as claimed in claim 2, wherein each bend head includes a rotatable spindle extending on said horizontal bend axis, said bend dies being supported at spaced intervals on the respective spindles, and each spindle extending inwardly towards the other bend head and having an inner end, the inner end of each spindle being spaced from the inner end of the other spindle, and the support frame includes a first brace for rotatably supporting the spindle of the first bend head and a second brace rotatably supporting the spindle of the second bend head.

4. The machine as claimed in claim 1, including first and second spaced pressure dies movably mounted on t he frame for movement between an advanced position engaging a portion of a pipe rearward of the bend and clamp dies of the first and second bend heads, respectively, and a retracted position spaced from the pipe.

5. The machine as claimed in claim 4, including first and second pressure die actuators for moving the respective first and second pressure dies in a direction transverse to the pipe axis between said advanced and retracted positions, and third and fourth pressure die actuators for moving the first and second pressure dies, respectively, in the first direction to feed the pipe in a longitudinal direction as a bend is being formed.

6. The machine as claimed in claim 1, wherein the mounting assembly includes a horizontal slide block slidably mounted on the forward end of the machine bed for movement in said horizontal direction transverse to the pipe axis, and the support frame is slidably mounted on said horizontal slide block for movement in a vertical direction between a raised position in which said bend dies are raised above a pipe and a lowered, operative position in which a selected bend die contacts a pipe in a bending position.

7. The machine as claimed in claim 6, wherein each clamp die is movably mounted on the respective bend head for vertical movement between a lowered position spaced below a pipe and a raised, operative position co-operating with the respective bend die to grip a pipe between the bend and clamp dies in the operative positions.

8. A dual headed bending machine, comprising:

an elongate machine bed having a forward end;

a dual bend head assembly at the forward end of the machine bed, the dual bend head assembly having a support frame and first and second spaced bend heads rotatably mounted on the frame for rotation about a horizontal bend axis aligned with the bend axis of the other bend head, each bend head having at least one pair of opposing bend and clamp dies defining a die cavity, the die cavities being spaced along said horizontal bend axis;

a carriage mounted on the machine bed for movement in a first direction towards the dual bend head assembly;

a pipe holder on the carriage supporting a pipe having a pipe axis aligned with the first direction for relative rotation with the bend head assembly;

a mounting assembly mounting the dual bend head assembly on the forward end of the machine bed for translational movement in a horizontal direction transverse to the pipe axis between at least two horizontally spaced positions in which the pipe is aligned with the die cavity of the first and second bend head, respectively:

the mounting assembly including a horizontal slide block slidably mounted on the forward end of the machine bed for movement in said horizontal direction transverse to the pipe axis, and the support frame being slidably mounted on said horizontal slide block for movement in a vertical direction between a raised position in which said bend dies are raised above a pipe and a lowered, operative position in which a selected bend die contacts a pipe in a bending position;

each clamp die being movably mounted on the respective bend head for movement between a lowered position spaced below a pipe and a raised, operative position co-operating with the respective bend die to grip a pipe between the bend and clamp dies in the operative position; and the bend head assembly including a first drive assembly for moving the horizontal slide block in said horizontal direction transverse to the pipe axis, and a second drive assembly for moving the support frame in a vertical direction to move the bend dies between the raised position and lowered, operative position, each bend head having a third drive assembly for moving a respective clamp die between the lowered position and the raised, operative position, and a fourth drive assembly for driving each bend head to rotate upwardly about said bend axis to form a bend.

9. A method of forming a series of closely spaced bends in a pipe, comprising the steps of:

mounting a pipe having a longitudinal pipe axis in a carriage on a machine bed for movement in a longitudinal, horizontal feed direction aligned with the pipe axis towards a dual bend head assembly having spaced first and second bend heads located at the front end of the machine bed, each bend head having a horizontal bend axis transverse to the pipe axis and at least one pair of opposing bend and clamp dies, each bend axis being aligned and co-axial with the bend axis of the other bend head, the bend and clamp dies being horizontally spaced along the horizontal bend axis;

positioning opposing bend and clamp dies on each bend head in a retracted position;

advancing the pipe towards the bend head assembly until a selected location on the pipe at which a first bend is to be formed is aligned with the bend and clamp dies;

moving the bend head assembly in a horizontal direction transverse to the pipe axis and aligned with the horizontal bend axis to align a selected pair of opposing bend and clamp dies on the first or second bend head with the pipe;

lowering the bend head assembly in a vertically downward direction transverse to the horizontal bend axis and the pipe axis until the selected bend die contacts the pipe;

raising the selected clamp die vertically upwardly to contact the pipe and clamping the pipe between the opposing bend and clamp dies;

rotating the bend and clamp dies upwardly about the horizontal bend axis to form a first bend in the pipe;

retracting the bend and clamp dies to release the pipe;

moving the pipe axially to advance the first bend and align a new position on the pipe with the bend and clamp dies;

traversing the bend head assembly in a horizontal direction transverse to the pipe axis and aligned with the horizontal bend axis to align a second selected pair of opposing bend and clamp dies on the first or second bend head with the pipe;

relatively rotating the pipe and bend head until the pipe is in a predetermined orientation in the bend head relative to the first bend;

clamping the new position on the pipe between the opposing bend and clamp dies;

rotating the bend and clamp dies upwardly about the horizontal bend axis to form a second bend in the pipe;

retracting the dies to release the pipe; and repeating the pipe advancing, bend head assembly traversing, pipe rotating, pipe clamping and rotating operations to form a plurality of successive bends in a pipe, using the first and second bend heads selectively to form bends dependent on the orientation of the previously formed bends to ensure that the previously formed pipe section does not strike any portion of the bend head assembly when a subsequent bend is formed.

10. The method as claimed in claim 9, including the steps of moving a pressure die into contact with the pipe rearward of the bend and clamp dies when the bend and clamp dies are in clamping engagement with the pipe, urging the pressure die against the pipe, and moving the pressure die in a pipe feed direction so as to feed the pipe longitudinally as the bend is formed.

11. The method as claimed in claim 10, including the step of applying a variable boost to the pipe in the pipe feed direction as a bend is formed.

12. A method of forming a series of closely spaced bends in a pipe, comprising the steps of:

mounting a pipe in a carriage on a machine bed for movement in a longitudinal, horizontal feed direction aligned with the pipe axis towards a dual bend head assembly located at the front end of the machine bed, the dual bend head assembly having a support frame and first and second bend heads rotatably mounted on the frame for rotation about a horizontal bend axis transverse to the pipe axis, each bend axis being aligned and co-axial with the bend axis of the other bend head, each bend head having a plurality of pairs of opposing bend and clamp dies, the bend and clamp dies being horizontally spaced along the horizontal bend axis;

sliding the support frame vertically upwardly relative to a horizontal slide block on which the support frame is slidably mounted so as to position the bend dies in a retracted, raised position;

moving each clamp die vertically downwardly relative to the opposing bend die into a lowered, retracted position;

advancing the pipe towards the bend head assembly until a selected location on the pipe at which a first bend is to be formed is aligned with the bend and clamp dies;

sliding the horizontal slide block horizontally in a direction transverse to the pipe axis and parallel to the horizontal bend axes so as to move the bend head assembly in a horizontal direction transverse to the pipe axis to align a selected pair of opposing bend and clamp dies on the first or second bend head with the pipe;

sliding the support frame vertically downwardly so as to position the selected bend die into a lowered, operative position in contact with the pipe;

raising the selected clamp die vertically upwardly into an operative position contacting the pipe and clamping the pipe between the opposing bend and clamp dies;

rotating the bend and clamp dies upwardly about the horizontal bend axis to form a first bend in the pipe;

retracting the bend and clamp dies to release the pipe;

moving the pipe axially to advance the first bend and align a new position on the pipe with the bend and clamp dies;

traversing the bend head assembly in a horizontal direction transverse to the pipe axis and aligned with the horizontal bend axis to align a second selected pair of opposing bend and clamp dies on the first or second bend head with the pipe;

relatively rotating the pipe and bend head until the pipe is in a predetermined orientation in the bend head relative to the first bend;

clamping the new position on the pipe between the opposing bend and clamp dies;

rotating the bend and clamp dies upwardly about the horizontal bend axis to form a second bend in the pipe;

retracting the dies to release the pipe; and repeating the pipe advancing, bend head assembly traversing, pipe rotating, pipe clamping and rotating operations to form a plurality of successive bends in a pipe, using the first and second bend heads selectively to form bends dependent on the orientation of the previously formed bends to ensure that the previously formed pipe section does not strike any portion of the bend head assembly when a subsequent bend is formed.

13. A dual headed bending machine, comprising:

an elongate machine bed having a forward end;

a dual bend head assembly at the forward end of the machine bed, the dual bend head assembly having a support frame and first and second spaced bend heads rotatably mounted on the frame for rotation about a horizontal bend axis aligned with the bend axis of the other bend head each bend head having at least one pair of opposing bend and clamp dies defining a die cavity, the die cavities being spaced along said horizontal bend axis;

a carriage mounted on the machine bed for movement in a first direction towards the dual bend head assembly;

a pipe holder on the carriage supporting a pipe having a pipe axis aligned with the first direction for relative rotation with the bend head assembly;

a mounting assembly mounting the dual bend head assembly on the forward end of the machine bed for translational movement in a horizontal direction transverse to the pipe axis between at least two horizontally spaced positions in which the pipe is aligned with the die cavity of the first and second bend head, respectively;

a first drive assembly for moving the dual bend head assembly in said horizontal direction transverse to the pipe axis;

a second drive assembly for moving the support frame in a vertical direction relative to the front end of the machine bed to move the bend dies between a raised, retracted position raised above a pipe and a lowered, operative position contacting a pipe in a bending position in the die cavity of the respective bend and clamp dies; and each bend head having a third drive assembly for moving a respective clamp die vertically relative to the bend die between a lowered position spaced below a pipe and a raised, operative position contacting a pipe positioned in the die cavity formed between the respective bend and clamp dies so as to clamp a pipe between the bend and clamp dies in the operative positions, and a fourth drive assembly for driving the respective bend head to rotate upwardly about said bend axis to form a bend.

* * * * *